US011408433B2

(12) United States Patent
Barrow

(10) Patent No.: US 11,408,433 B2
(45) Date of Patent: Aug. 9, 2022

(54) CENTRIFUGAL PUMP ASSEMBLY AND IMPELLER

(71) Applicant: Boyce Barrow, Vientiane Capital (LA)

(72) Inventor: Boyce Barrow, Vientiane Capital (LA)

( * ) Notice: Subject to any disclaimer, the term of this patent is extended or adjusted under 35 U.S.C. 154(b) by 52 days.

(21) Appl. No.: 16/955,463

(22) PCT Filed: Dec. 21, 2018

(86) PCT No.: PCT/AU2018/051407
§ 371 (c)(1),
(2) Date: Jun. 18, 2020

(87) PCT Pub. No.: WO2019/119073
PCT Pub. Date: Jun. 27, 2019

(65) Prior Publication Data

US 2020/0370561 A1 Nov. 26, 2020

(30) Foreign Application Priority Data

Dec. 21, 2017 (AU) ..... 2017905113

(51) Int. Cl.

| | |
|---|---|
| ***F04D 29/10*** | (2006.01) |
| ***F04D 29/22*** | (2006.01) |
| ***F04D 29/16*** | (2006.01) |
| ***F04D 29/62*** | (2006.01) |
| *F04D 7/04* | (2006.01) |

(52) U.S. Cl.
CPC ..... *F04D 29/10* (2013.01); *F04D 29/108* (2013.01); *F04D 29/167* (2013.01); *F04D 29/22* (2013.01); *F04D 29/622* (2013.01); *F04D 7/04* (2013.01); *F04D 29/2294* (2013.01)

(58) Field of Classification Search
CPC ..... F04D 7/04; F04D 29/10; F04D 29/108; F04D 29/167; F04D 29/22; F04D 29/2294; F04D 29/622; F16J 15/002; F16J 15/184; F16J 15/3404
See application file for complete search history.

(56) References Cited

U.S. PATENT DOCUMENTS 2,736,265 A * 2/1956 Higgins ..... F04D 29/167 415/172.1
3,966,351 A * 6/1976 Sproule ..... F01D 11/04 415/110
4,204,689 A * 5/1980 Johansson ..... F16J 15/24 277/583

(Continued)

*Primary Examiner* — Richard A Edgar
*Assistant Examiner* — Jason G Davis
(74) *Attorney, Agent, or Firm* — Maschoff Brennan

(57) ABSTRACT

In centrifugal pumps and, in particular, pumps for transferring fluids containing abrasive particles such as slurry pumps, wear of wetted areas is a major maintenance issue. The invention provides for the protection of internal surfaces vulnerable to wear from such particles by providing means for adjusting and controlling distribution of gland fluid for flushing vulnerable areas. The invention extends to a method and a retrofit kit, but provides primarily for a centrifugal pump assembly comprising an impeller rotatably mounted therein and support means operatively arranged for supporting the impeller from its suction side in sealing relationship with the housing. The sealing means may be mechanically adjustable for substantially even distribution of gland fluid to both axial sides of the impeller in the pump housing.

13 Claims, 9 Drawing Sheets

(56) References Cited

U.S. PATENT DOCUMENTS 4,729,724 A * 3/1988 Henning ..... F04D 25/06
277/646
5,772,218 A * 6/1998 Burgess ..... F04D 29/108
277/516

* cited by examiner (a) PRIOR ART (b)

CENTRIFUGAL PUMP ASSEMBLY AND IMPELLER

FIELD OF INVENTION

This invention relates to centrifugal pumps and in particular, pumps for transferring fluids containing abrasive particles. It applied specifically to slurry pumps and provides for the protection of internal surfaces vulnerable to wear from such particles.

The invention is intended for implementation in new pumps but is also well suited to implementing in pump refurbishments and rebuilds, facilitating wet end replacement. Wet end in the art and in this invention refers to the following components: impeller, volute liner, throat bush and frame plate liner.

BACKGROUND TO THE INVENTION

A significant operating cost borne by operators of pumps for transferring abrasive liquids, such as slurries, is related to the wear caused to components coming into contact with the fluid. In conventional slurry pumps, the clearance between throat bush and impeller, normally a millimetre or less, requires periodic adjustment as the throat bush and impeller-face wear, creating a significant maintenance burden. To address this, barriers have been developed to prevent abrasive particles reaching key components and their exposed or wetted surfaces.

An aspect of barrier protection involves injecting a clear fluid i.e. one that is free of abrasive particles, into vulnerable areas, thereby to keep abrasive particles in the fluid being pumped or transferred from reaching them during transit through the pump.

At least one prior publication describes the general concept of providing a flushing mechanism for removing abrasive particles from sealing zones within the volute of a slurry pump, one of these showing water injected through a floating sealing ring into the gap between the impeller and the suction end wall of the volute. For example, U.S. Pat. No. 4,037,985, which focuses on slurry pumps, teaches that the front shroud of the impeller housing must be operatively associated with a suitable wearing ring and, further, that a flushing liquid system (generally water) must be provided to prevent abrasion and excessive wear between the wearing ring and the impeller.

U.S. Pat. No. 5,772,218 (Burgess) teaches providing a lantern ring about the impeller shaft and introducing a fluid for flushing (water), recognizing that slurry particles cause additional friction and wear to the packing and sleeve. The water is injected into the assembly via a feed channel to a lantern ring assembly comprising a lantern ring and a restrictor formed of metal. In FIG. 2 of Burgess, the ring is non-metallic. In FIG. 3 there is a lantern ring spaced from a neck ring by a packing. The lantern ring and lantern restrictors direct the water introduced via a channel (numbered 14) into a gap around the shaft or sleeve thereon. This allows water into the critical gap between the packing 5 and the shaft 50 for proper and effective lubrication. Both lantern ring and lantern ring restrictor arrangements allow some sealing water to flow into the pump. This has the desired effect of flushing solids or particles away from the sealing assembly, hence minimising the risk of slurry contamination. However, it is found that such an arrangement may lead to slurry dilution through increased water introduction to the system.

A further drawback in the prior art is that the presence of a throat bush adds a wear-susceptible component to an already abrasive system, increasing the range of opportunity for component failure and consequent downtime.

A need therefore exists for a solution for inhibiting if not entirely eliminating slurry ingress to the space between the housing wall and the impeller.

The preceding discussion of the background to the invention is intended to facilitate an understanding of the present invention. However, it should be appreciated that the discussion is not an acknowledgement or admission that any of the material referred to was part of the common general knowledge in Australia or elsewhere as at the priority date of the present application.

Further, and unless the context clearly requires otherwise, throughout the description and the claims, the words 'comprise', 'comprising', and the like are to be construed in an inclusive sense—that is in the sense of "including, but not being limited to"—as opposed to an exclusive or exhaustive sense—meaning "including this and nothing else".

SUMMARY OF INVENTION

According to a first aspect of the invention, there is provided a centrifugal pump assembly comprising a housing having a suction side inlet and a fluid delivery outlet, a shrouded impeller rotatably mounted therein, and support means operatively arranged for supporting the impeller from its suction side in sealing relationship with the housing.

In a preferred form of the invention, the support means comprises a fluid-receiving conduit extending coaxially outwardly from the impeller into in the suction-side inlet of the housing.

In a further preferred form of the invention, said sealing relationship is established by a restrictor assembly installed in the inlet to operatively bear against an outer surface of the extending conduit.

Preferably, the restrictor assembly comprises a fluid-activated restrictor body.

Further preferably, the restrictor assembly includes means operable for adjusting fluid pressure being exerted on the restrictor body, the body having a surface arranged for operatively sealing against an opposing surface of the annular conduit The restrictor assembly may comprise a groove in a surface of the inlet, a lantern-type ring restrictor operatively seated in the groove, and means for applying fluid under pressure against the restrictor while in the groove to urge the restrictor against the conduit outer surface in sealing relationship.

Preferably, the fluid pressure is controllably adjustable.

Further preferably, the restrictor assembly comprises first and second lantern-type restrictors in the groove and separator means between the restrictors.

The separator may be configured to define a riser through which flushing fluid is introduced to the groove to permeate between the restrictors and the conduit outer surface.

In an embodiment, the restrictor assembly comprises an adjustably positionable restrictor body for sealing against the extended conduit and mechanical means operable to adjust the body position.

Preferably, the mechanical means causes displacement of the body in an axial direction substantially parallel to the impeller shaft.

The shaft sealing means in an embodiment comprises a restrictor assembly having a lantern-type ring, which is applied between the housing and a shaft-receiving portion extending shaft-side of the impeller.

In a further preferred form of the invention, the extension conduit comprises a formation integral with the impeller.

In a further preferred form of the invention, the fluid distribution means is configured for promoting substantially equal distribution of gland water from a source on a first side of the impeller to a gallery on an opposite second side of the impeller.

Preferably, an inlet to the housing includes an annular ring coaxially located with the extension and abutting the exteriorly directed face thereof.

Still further, according to the invention, the assembly includes flushing means adapted for introducing flushing fluid externally to the extension into a space defined between extension and inlet wall.

In preferred embodiments, the assembly does not include a throat bush.

According to a second aspect of the invention there is provided an impeller for a centrifugal pump, the impeller being rotatably mountable within a pump housing on a shaft and having a suction side adapted to be rotatably supported by, and in fluid-sealing relationship with, the housing, when operatively mounted therein.

According to a preferred form of the invention, the impeller is adapted by means of having on its suction side an outwardly extending annular conduit coaxial with the shaft. Preferably, the extending conduit is adapted for being rotatably received within the housing inlet.

In a preferred embodiment, the impeller comprises a first arrangement of primary fluid-moving vanes and a second arrangement of secondary vanes configured for moving a flushing fluid, the primary and secondary vanes adapted to rotate in unison.

Preferably, the impeller further comprises fluid distributing means adapted for distributing flushing fluid to either side of the primary vanes.

According to a third aspect of the invention there is provided a method of operating a centrifugal pump having a shrouded impeller and a housing within which the impeller is mountable for use, the housing having a suction side inlet and a fluid delivery outlet, the method comprising the steps of operatively mounting the impeller to a drive shaft for connecting to a drive source and rotatably supporting the impeller from its suction side in sealing relationship with the housing.

In a preferred form of the invention, the method includes the step of providing the impeller with a conduit extending coaxially from its suction side and operatively locating the extending conduit in the housing inlet to be rotatable therein.

The method preferably includes arranging sealing means in the suction inlet for operatively establishing a fluid seal between an inner surface of the inlet and an outer surface of the conduit.

In an embodiment, the step of establishing the fluid seal includes providing a restrictor assembly, installing it operatively to bear against an outer surface of the extending conduit and applying radial pressure to a restrictor body of the restrictor assembly to urge it against the outer surface of the conduit when rotating.

In a still further preferred form of the invention, the method includes the step of establishing a shaft-side seal between the impeller and the housing by urging a restrictor body of the restrictor assembly in sealing relationship against a shaft-receiving portion extending shaft-side of the impeller. The method may further comprise using a lantern restrictor assembly comprising shaft sealing means, wherein a restrictor assembly having a lantern-type ring is applied between the housing and a shaft-receiving portion extending shaft-side of the impeller.

The method preferably further comprises providing sealing means between a circumferential edge of the impeller and an adjacent internal wall of the housing.

According to a fourth aspect of the invention there is provided a shrouded impeller having a shaft side and a suction side, said suction side adapted for fluid transfer connection to a suction line by means of an annular extension receivable into a pump housing suction inlet.

In a preferred form of the invention, the impeller includes an annular extension on the suction side, coaxially located.

In an embodiment, the annular extension is fixed to the impeller. In a preferred embodiment, the extension is fixed to be rotatable with the impeller in use.

According to a fifth aspect, the invention provides a slurry pump modifying kit comprising:

a. means for boosting gland liquid pressure in a slurry pump, said means being operable for keeping particulate matter away from shaft sealing means; and
   a. means for promoting even gland liquid flow within a pump housing either side of a primary impeller installed in the pump housing.

The gland pressure boosting means preferably comprises a secondary impeller rotatable in unison with the primary impeller.

The kit preferably includes shrouding means for the secondary impeller and, optionally, fastening means for connecting the secondary impeller to the primary impeller.

In a preferred form of the kit, the means for promoting even gland liquid flow comprises a fluid communications passage extending through a vane arrangement of the primary impeller.

The fluid communications passage preferably extends from a cavity occupied by the secondary impeller to an impeller-free gallery on an opposite side of the primary impeller.

The kit may in an embodiment also include a volute liner shaped to have an extending lip that when installed overlaps a periphery seal associated with the primary impeller, whereby a static fluid zone is created in use. The volute liner may be supplied in a single piece, or in two or more pieces.

In a preferred embodiment the kit comprises a throat sealing mechanism operatively disposable on an axial side of the primary impeller, the mechanism including a pressure-activated part for bearing against the impeller shaft or throat in sealing abutment in use.

BRIEF DESCRIPTION OF DRAWINGS

In order that the invention may be readily understood, and put into practical effect, reference will now be made to the accompanying figures. Thus.

DETAILED DESCRIPTION OF EMBODIMENTS OF THE INVENTION

Although the invention may be applied to most types of centrifugal pumps having a shrouded impeller, it is particularly intended for service in slurry pumps and will be described in this context. However, this should not cause any such service limitation to be inferred.

The invention is suited for implementation in pumps that make use of a secondary impeller as well as a primary impeller. In the present invention, the secondary impeller functions as an expeller, distributing gland water to both sides of the pump casing—shaft side and throat side—in substantially even quantities, as will be discussed in the paragraphs following.

The invention is for implementation in new pumps as well as to wet end replacement in pump refurbishments and rebuilds. The following components, impeller, throat bush and frame plate liner, are replaced in a kit comprising an impeller and a throat restrictor assembly for supporting the impeller at each of the throat and shaft sides. Optionally, the volute liner may also be replaced and a replacement may be included in the kit. The invention extends to provision of an impeller configured for optimal functioning with the restrictor assembly, which may take different forms, within the scope of the appended claims.

Figure 1:
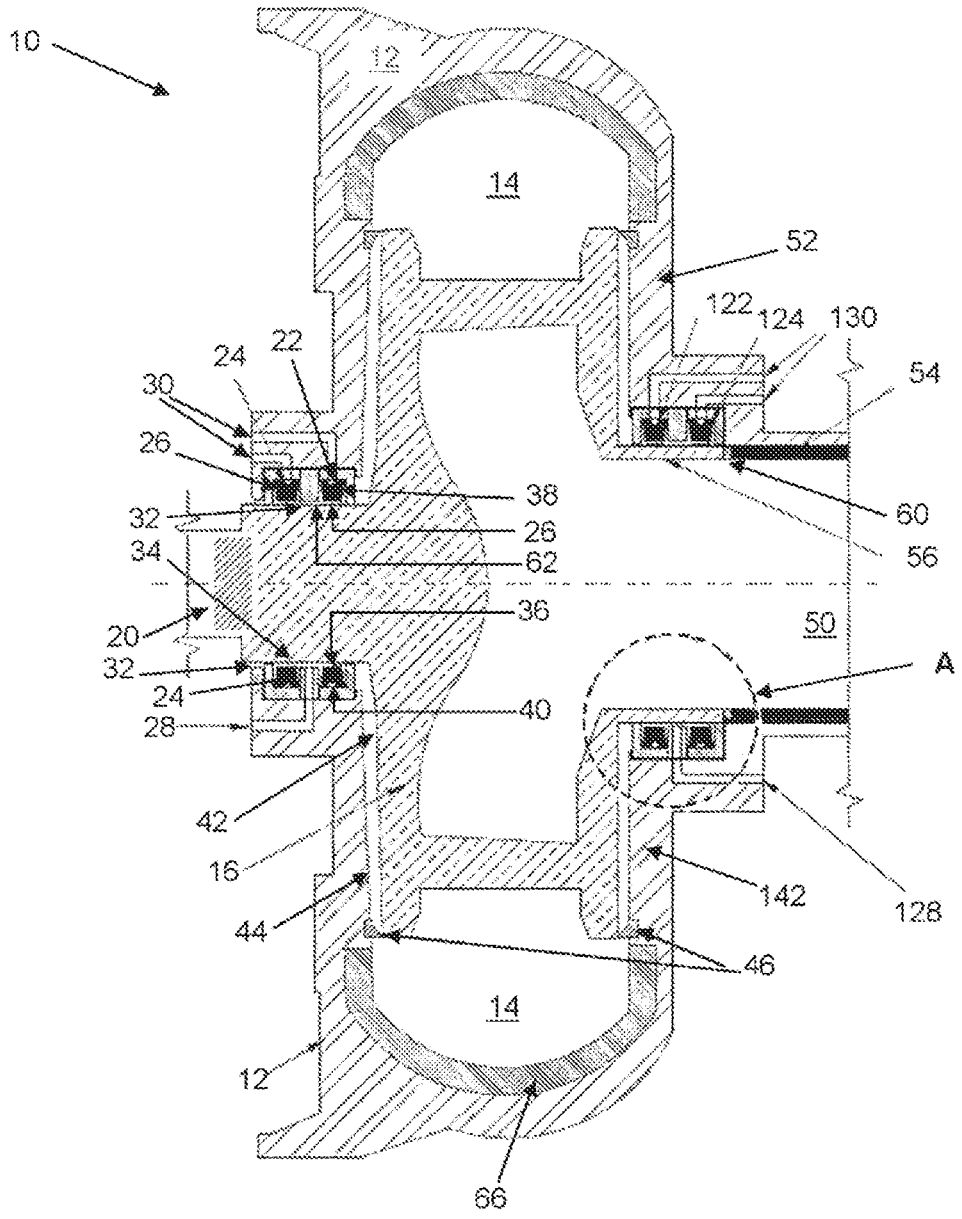
FIG. 1 shows in schematic cross section a diagram of a slurry pump assembly in a preferred embodiment of the invention.

Referring to FIG. 1, in an exemplary embodiment of this invention, a slurry pump according to the invention is generally denoted by the number 10 and is shown in sectional side view.

In this embodiment, the pump is made up of a housing 12, defining an internal volute 14 in which an internal vane impeller 16 is rotatably mounted on a shaft 20, as is conventional in the art. The shaft is mechanically connected in power transmission relationship with a motor, not shown, providing rotational force to the shaft, thereby to drive the impeller, whereby a fluid, in the form of a slurry (shown in FIG. 3) is pumped from the housing inlet at the suction (low pressure) side of the pump, to a radially-located delivery outlet (not shown), being the pressure side of the pump.

Figure 2:
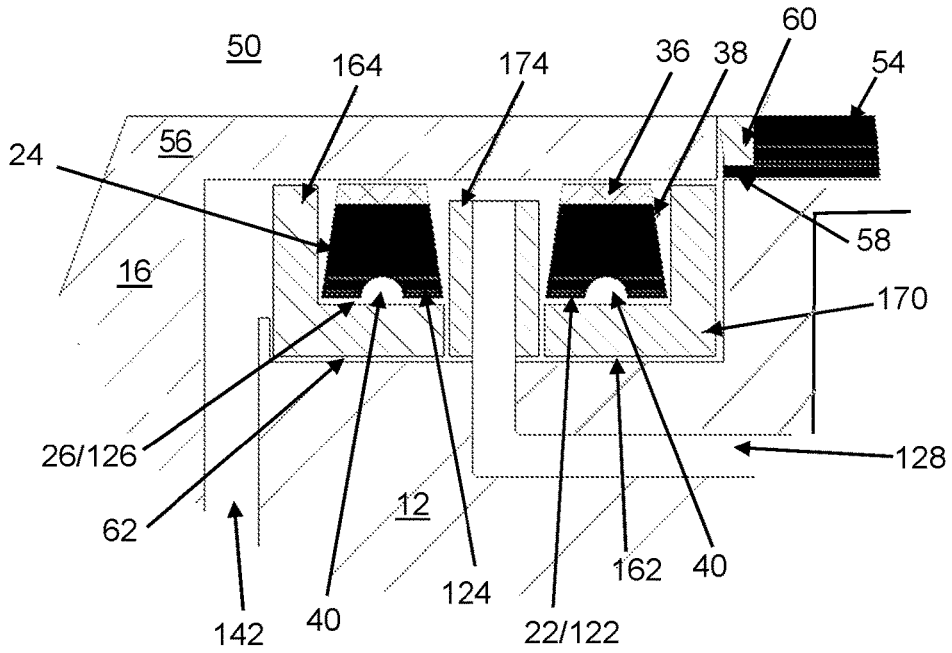
FIG. 2 is a view of the detail in the ringed portion marked A in FIG. 1. It presents a cross-sectional close up view of the flushing system of the invention.

On the shaft-side of the impeller and in contact with the spinning impeller body in use is a pair of adjustable lantern restrictors 22,24. The adjustable lantern restrictors are made of two component parts: A thermoplastic inner ring 36 that is brought to bear against the outer surface of the throat to be sealed and an elastomeric backing ring 38. A similar arrangement is provided on the inlet/suction side of the impeller. This is shown in the detail of FIG. 2. The backing ring has on its outer circumferential surface a groove 40 of hemispherical profile, wherein pressure fluid may enter to assist in exerting substantially even radial force into the body of the elastomeric backing ring, thereby activating, or "energizing" it into sealing contact with the rotating throat extension portion 56 (see below).

Flushing fluid is introduced to the grooves 26 housing the lantern restrictors via port 28. To manage, control and adjust seal pressure exerted by means of the lantern restrictors on the shaft, a conduit 30 connects each variable lantern restrictor to a reservoir of pressure fluid (not shown) external to the housing. The pressure fluid in this example is air. However, in other embodiments, it may be a liquid, for example an hydraulic grade oil. In another embodiment it is clean water. The pressure the fluid exerts on the lantern restrictors is regulated, using pressure-management devices of conventional design.

Flushing fluid, introduced from an external source via port 28 to the lantern restrictor grooves 26, passes from these grooves to the space 32 between the restrictors and the circumferential outer surface of impeller shaft-receiving socket 34.

Flushing fluid then exits into the circular disc-like space, also referred to as a gallery, 42 between the shaft-side of the impeller and the back wall 44 of the housing. Its presence, occupying gallery space 42, helps exclude abrasives from the slurry from entering this space and consequently to reduce wear on the opposed surfaces of impeller and housing back wall 44.

A peripheral sealing ring 46 between housing back wall 44 and the shaft-side circumferential extremity of the impeller, further assists in preventing ingress of slurry to space 42. These periphery seals 46 and sleeve seal 60 (described below) do not engage their respective faces in the presence of flushing fluid (e.g. water) as the fluid will be passing through the seals 'flushing' them. Sealing will occur in the absence of flushing fluid (i.e. when a power cut or shut-off occurs).

The periphery seals help ensure that the pump housing, the liners as well as the outside radially-extending surfaces of the impeller are not exposed to slurry, therefore helping avoid associated wear.

The sealing assembly described above on the shaft side of the impeller is functionally replicated on the suction inlet side of the impeller in this embodiment. Like parts are like numbered, but for the prefixing of the number 1 to each, so that (for example) part 22 has a corresponding suction side equivalent 122.

To accommodate the like sealing arrangement of the shaft side at the suction side, an additional sleeve portion is added to the impeller, allowing the impeller to seal against lantern restrictors at the inlet of the pump in a similar manner to the sealing provided at the shaft side. Instead of the impeller receiving a solid shaft, at the suction side a passage is defined, leading from the additional extending sleeve to the internal vanes. This provides a seal against slurry as well as an additional support for the shaft/impeller (semi rigid liquid lubricated bearing assembly).

On the inlet side of impeller 16, inlet passage 50 passes through the suction side wall 52 of housing 12 and is lined with an annular sleeve 54. The sleeve is made of hardened steel and is replaceable, its location rendering it vulnerable to rapid wearing. Non-limiting examples of suitable materials of construction for sleeve 54 are selected metals, including high chrome steel, chrome molybdenum steel, carbon steels and white iron, ceramics, elastomers, rubber and plastics, such as polyurethane.

Impeller 16 has an annular throat portion 56 which extends outwardly, beyond housing wall 52 into inlet 50, until it reaches a state of virtual abutment with sleeve 54. Shown in FIG. 2 is a close-up view showing detail of the meeting between sleeve 54 and extending throat 56, enclosed in FIG. 1 by callout ring A. Sleeve 54 ends at the impeller end in a stepped cutaway 58, which is occupied by an end-sealing ring 60. Ring 60 is preferably of an elastomeric or thermoplastic material and serves to help prevent slurry ingress between rotating throat 56 and housing 12, therefore helping eliminate associated wear.

Referring to FIG. 2 and the detail of the sealing assembly utilised at both shaft- and suction-sides of the impeller, adjacently opposite the extending throat 56 of impeller 16 is a circular channel 62 formed in the wall of housing 12. The outer wall of the channel substantially coincides with the farthest extent of impeller throat 56 into inlet 50. Within the groove are located a pair of pressure-adjustable restrictor rings 122, 124 of the kind numbered 22, 24 in FIG. 1.

The individual restrictor rings are seated against respective right-angled restrictor housing rings 164, 170 and are separated by a central spacer 174. Within the spacer is a conduit 128 through which flushing water is introduced to the unoccupied space in channel 62/162. The spacer defines a riser for the flushing fluid and does not extend as far towards the outer surface of extending throat 56 as the walls of angle rings 164, 170. This helps retain flushing fluid within grooves 26/126 and facilitates substantially even service of fluid to both restrictors 122, 124.

The circumferential peripheral inner surface of the volute of the housing is lined with a volute liner 66. In this embodiment, the volute liner is made of a hard material, suitable non-limiting examples of which include metals, such as high chrome steel, chrome molybdenum steel, carbon steels and white iron, ceramics, elastomers, rubber and plastics, such as polyurethane, preferably of the thermosetting type, and hard thermoplastics. These are known in the art and are not to be interpreted a limiting of the appended claims. The volute liner can be replaced independently of other components discussed, being the only portion of the pump housing liner exposed to the risk of high wear. As has been observed, the inlet liner sleeve is similarly vulnerable, but does not strictly form part of the housing liner.

Figure 3:
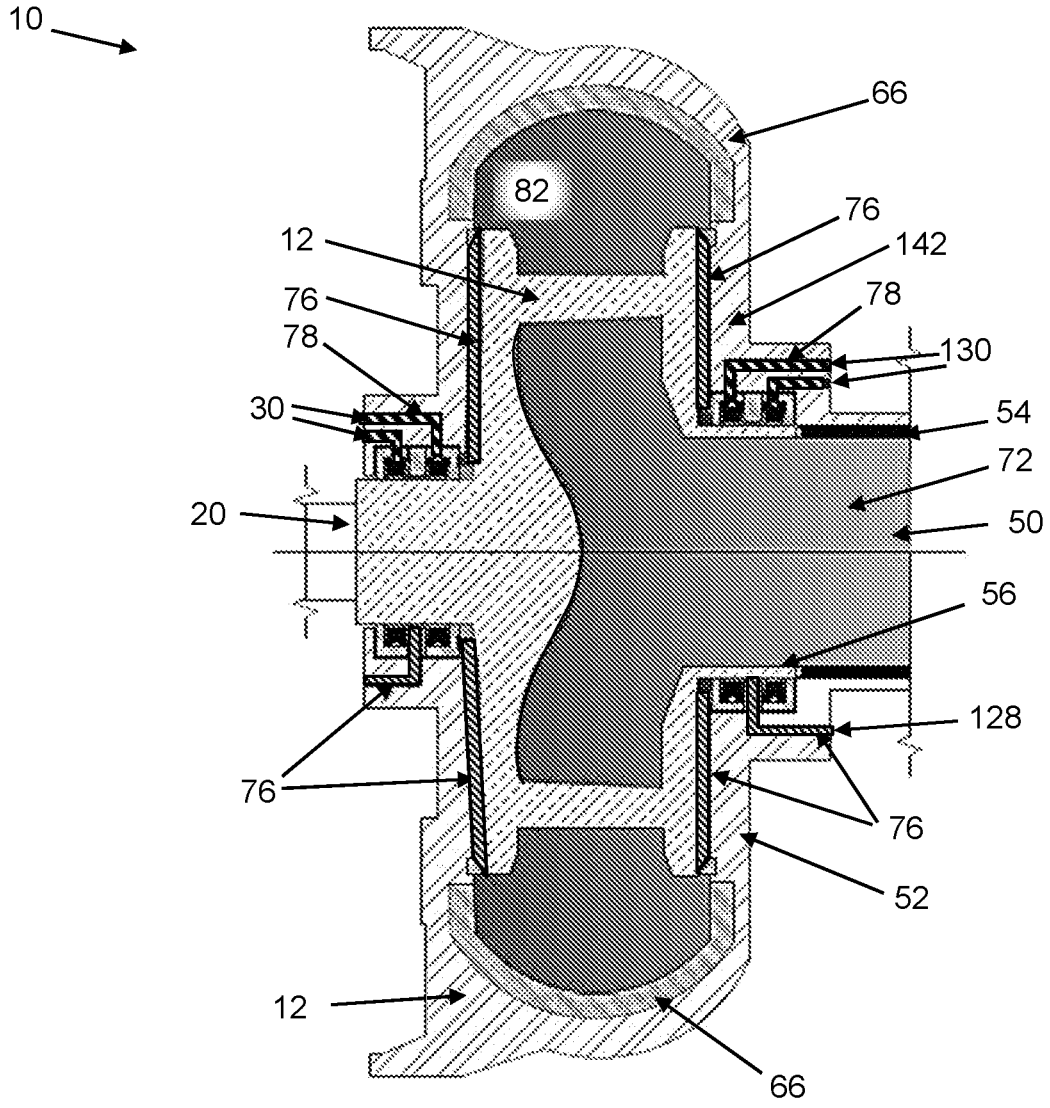
FIG. 3 is a schematic view of the fluid flow passages in the embodiment of FIG. 1.

FIG. 3 demonstrates the flow paths of the different fluids used in operating the pump assembly and impeller of the invention. The area 72, of relatively light grey filling, represents a flow of low pressure slurry entering via inlet 50. Higher pressure slurry 82 is represented by a darker shading. Flushing fluid 76 entering groove 62 occupied by lantern restrictor seals 22,24 or 122, 124 and passing through to fill space 42, 142 between impeller shroud and radially oriented housing walls is denoted by closely spaced hatching lines.

Externally sourced pressure regulating fluid 78, represented by the bolder cross-hatching, is introduced at either side of the impeller, through conduit tubes 30 and 130, to the grooves 40 (see FIG. 2) in the radially outer surfaces of restrictors 22,24 and 122, 124 remote from portion 36, which bears against extension 56 of impeller 16 in fluid sealing relationship. Pressure of fluid 78 is maintained and even increased by means of an external pumping means (not shown) when the pump is shut down, to maintain sealing around shaft-receiving portion 34 of the impeller and avoid allowing ingress of slurry particles.

Figure 4:
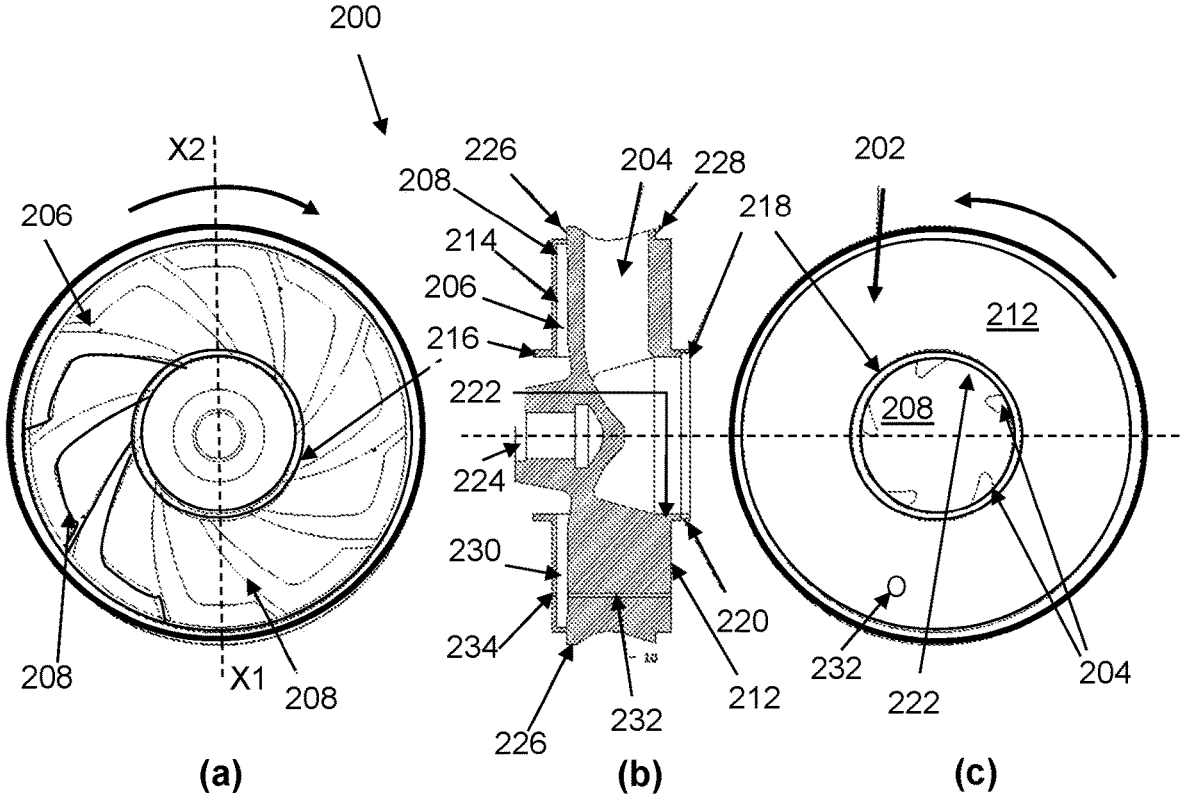
FIG. 4 illustrates an impeller assembly of the invention in shaft-side, suction side and cross-sectional radial views.

Referring now to FIG. 4, there is shown an example of an impeller unit 200 in shaft-side (a), radial cross-sectional (b) and suction side (c) views. The radial cross section in (b) is taken along line X1-X2 in (a). The impeller is suitable for utilisation with the invention in a preferred embodiment. The impeller unit can be considered to be made up of a primary impeller 202 having vanes 204 and a secondary impeller 206 having vanes 208. Both impellers are for mounting on a common rotatable shaft 224, so that they rotate in unison. Both are shrouded or of the closed vane type. Direction of rotation is denoted by the directional arrows in the front (a) and rear (c) views. Secondary impeller 206 is located shaft-side of primary impeller 202. Its function is to boost gland water pressure and assist in achieving substantially even flow of gland water to both sides of the pump.

The combined impeller unit may be made from a single cast, or may be provided as separate components for fastening together to spin in unison.

The vanes 204 of primary impeller 202 are visible in FIG. 4(*c*) through the suction-side throat inlet 210. The suction side of the impeller unit is a flat surface 212, as encountered in the embodiments of FIGS. 1-3.

Shaft-side of secondary impeller 206 and shown in FIG. 4(*c*) is a shroud 214, which extends to an annular extension 216 located substantially opposite an annular extension 218, on the suction side of primary impeller 202. The shroud restricts axial flow of flushing fluid being expelled by secondary impeller 206. Suction-side extension 218 terminates with a threaded step 220 on its inner radial surface 222.

The threaded sleeve allows for axial movement between the annular extension and the inlet wear sleeve 54 shown in FIGS. 1-4. The use of the threaded step will be described in relation to FIG. 6 to follow.

The distal circumferential extremities of primary impeller 202 are defined by steps 226, 228 on the shaft and suction sides respectively. These are for sealing against the pump chamber volute (not shown), also to be discussed below, using sealing rings of the kind shown by number 46 in FIG. 1.

Gland water enters the pump via the stuffing box (not shown) as is conventional in known pumps. To enable flushing fluid to be distributed from the secondary impeller gallery 230, located shaft-side to flat surface 212 on the suction side, one or more conduit ports 232 are formed in the vanes of primary impeller 202. A second set of ports 234, of smaller diameter pass through shroud 214, providing fluid communication between gallery 230 and the frame liner (not shown) or housing back wall 44 of the pump, illustrated in FIG. 1. The smaller conduits (or orifices) 234 are so sized to provide for a greater pressure drop for the fluid reaching external gallery space 42 (in FIG. 1) and thereby a substantially even distribution of gland water to both sides of the pump which are placed in fluid communication via the ports 232.

The movement in unison of the two impellers serves to allow fluid being moved by the secondary impeller to be moving at the same rate as fluid being moved by the primary impeller, providing for substantially equal pressure on either side of the dividing wall between them and balanced rotary motion, reducing shaft and bearing wear and lengthening impeller and pump life.

Figure 5:
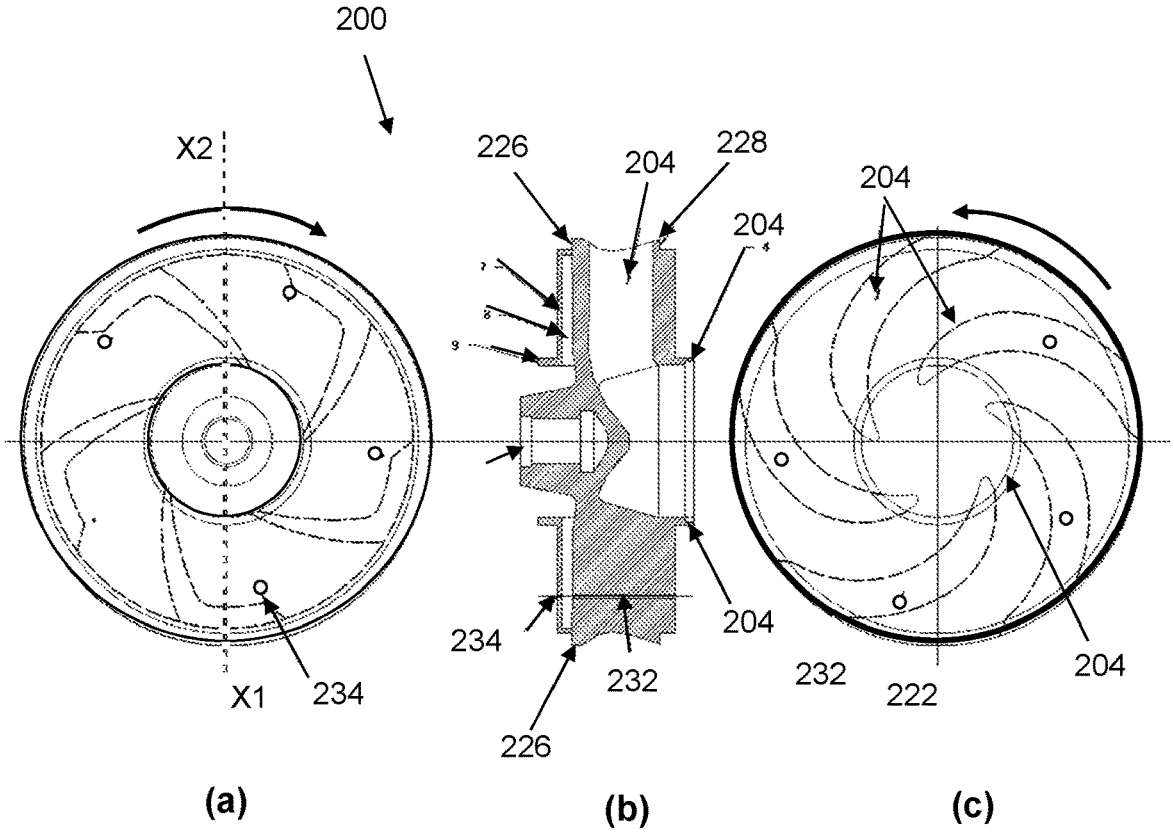
FIG. 5 shows an alternative impeller assembly in isometric shaft-side, suction side and cross-sectional radial views.

An alternative dual impeller unit is illustrated in FIG. 5. Like parts carry like numbering. The secondary impeller 206 has fewer vanes 208 than in the example of FIG. 4. In this isometric view, dashed lines shown the shape of the vanes 204 of the primary impeller 202.

Figure 6:
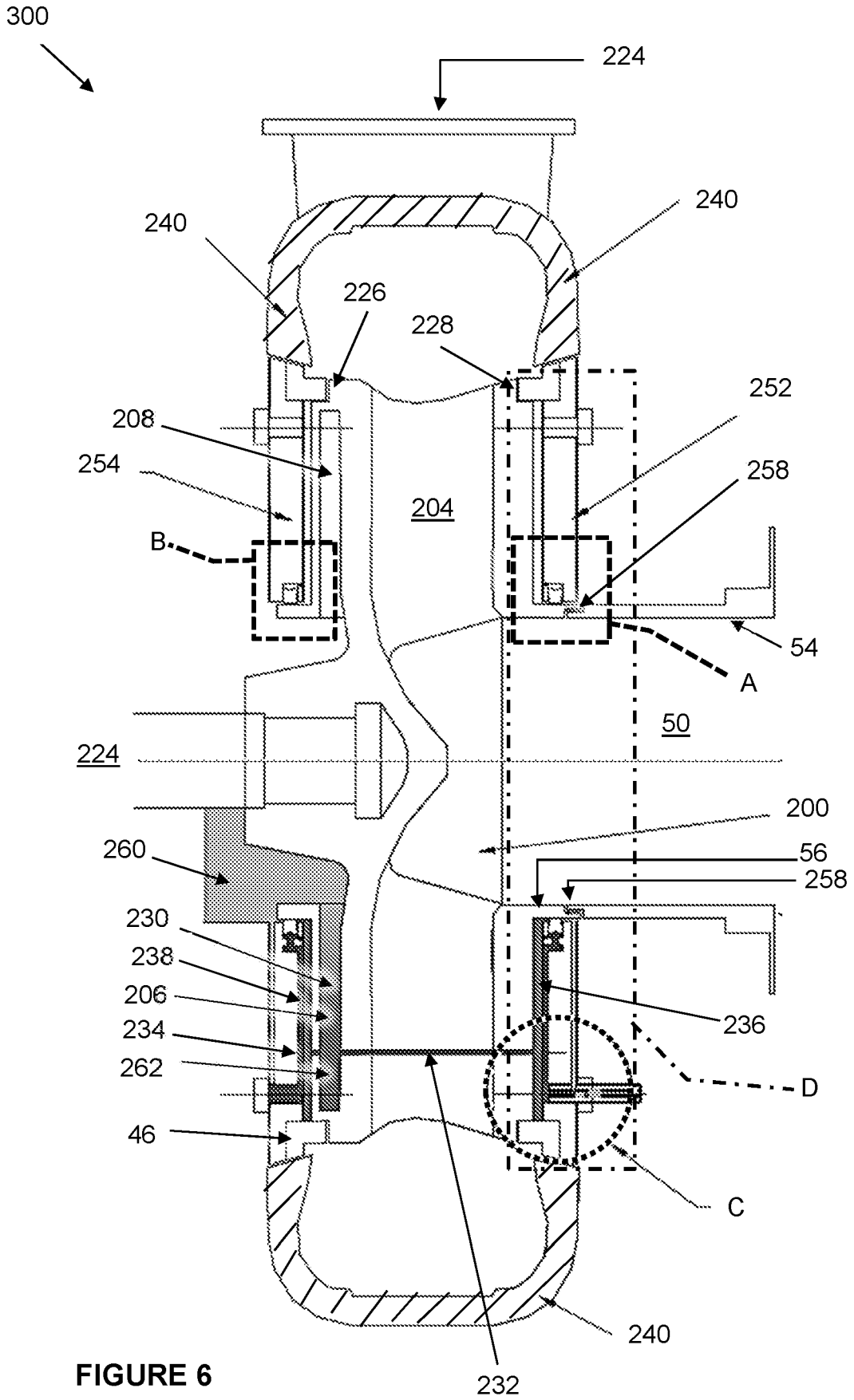
FIG. 6 is a view of a preferred embodiment of a pump wet end assembly of the invention, shown in vertical axial cross-section.

FIG. 6 is a view of a preferred embodiment of a pump wet end assembly 300 of the invention, shown in vertical axial cross-section. Detail of the circled area marked "C" is presented in FIG. 7. Shaded areas denote flow paths of fluids relevant to the present invention. Where convenient, like numbering of parts identified in FIGS. 1, 2, 3, 4 and 5 will be employed here. The pump body is shown with a volute liner 240, discharge port 242 and suction inlet 50. The volute liner is shown in a single piece in FIG. 6, but may be provided in two or more parts in other embodiments. The volute liner is manufactured from materials known in the art, including for example polyurethane.

The assembly of the invention is adapted to replace the wet end of prior art slurry pumps as will be described. In this embodiment, inlet wear sleeve 54 is snugly fitted to throat extension portion 56, which terminates with a threaded step 258. The step allows for axial movement between these parts. The wear sleeve is preferably included in the refit kit of the invention. The impeller position relative to the sleeve changes as the impeller drive shaft 224 expands and contracts with temperature changes. The step serves to maintain a substantially smooth and continuous wetted inlet surface for the working fluid, while accommodating the thermally induced movement. The threaded surface also allows for static pressure testing of an assembled pump to set the flushing liquid flow rate passing between the restrictor mechanism (see next paragraph) and annular extension portion 56.

In this embodiment, a throat restrictor mechanism 252 is positioned where the throat bush would normally be expected in a conventional pump. The throat restrictor can be compared with the variable lantern restrictor 22,24 and pressure energized pressure control function of the embodiment of FIG. 1. A secondary throat restrictor mechanism 254 of generally mirrored design to restrictor mechanism 252 is located shaft-side of impeller unit 200. These restrictor mechanisms have restrictor bodies that are supported using twin O-rings. The position of the suction side restrictor is adjustable for pressure adjustment, whereas the shaft-side restrictor is not.

As previously alluded to, gland water 260 enters the pump body via a stuffing box of conventional design (not shown) located about shaft 224 and proceeds to enter the secondary impeller gallery 230. The rotational action of secondary impeller 206 boosts the pressure in the gallery. This is denoted by the darkening of the shading at 262. The location of the water ports 232 (larger) and 234 (narrower) relative to the central axis of the impeller determines the amount of boost to the pressure. The farther spaced the ports are from the axis, the greater the boost. To provide a substantially even distribution of gland water between the inlet side and the shaft side of the pump adjacent main impeller 202, a generally axially parallel port 232 provides communication through the primary impeller body to the opposite side gallery 236.

On the shaft side, an orifice 234, substantially coaxial with port 232, provides fluid communication from gallery 230 to gallery space 238 against the secondary restrictor 254. Port 232 is significantly longer than orifice 234, so the latter is made of smaller diameter to compensate for pressure drop and promote even distribution of gland water. The gland water that passes through orifice 234 to space 238 is at a lower pressure than the water in space 230. The pressure ratio is approximately 90%.

Figure 7:
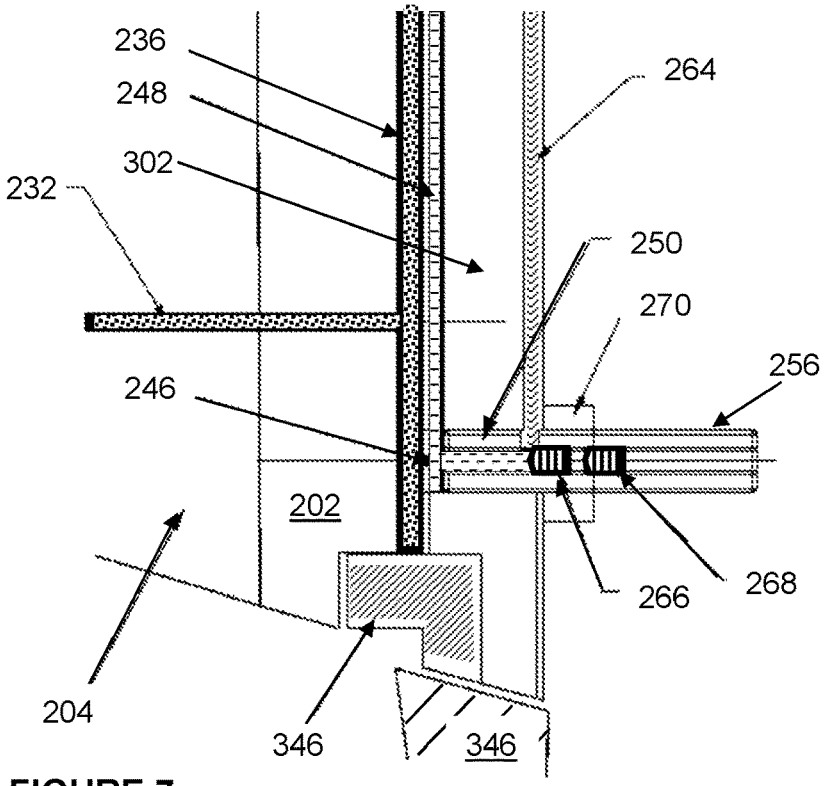
FIG. 7 is a cross-sectional view of the call-out C in FIG. 6.

Referring to FIG. 7, which shows detail of the componentry in callout circle C of FIG. 6 on the suction side of the pump, the gland water that has passed through conduit 232 travelling across impeller 202 is shown occupying space 236. From there it passes through an orifice 246, reducing pressure and entering space 248. Thereafter, it flows through a bore 250 formed in a modified mounting bolt 256, past a flow-controlling device in the form of a grub screw 266 into gallery 264 and on to the primary impeller inlet 50. Turning control grub screw 266, so that it moves progressively left in the drawing towards orifice 246, restricts water flow into gallery 264, thereby increasing energizing pressure acting on restrictor 252, and reducing the flow of water between the restrictor and primary annular throat extension 56. To increase flow, grub screw 266 is turned in the opposite direction. Once screw 266 has been set, it is locked by a second grub screw 268 inserted coaxially behind it and turned to advance along bore 250 into abutment with first screw 266. A locknut 270 serves to secure the bolt and grub screw assembly in place. Peripheral seal 346 abuts the periphery of volute liner 366.

Figure 8:
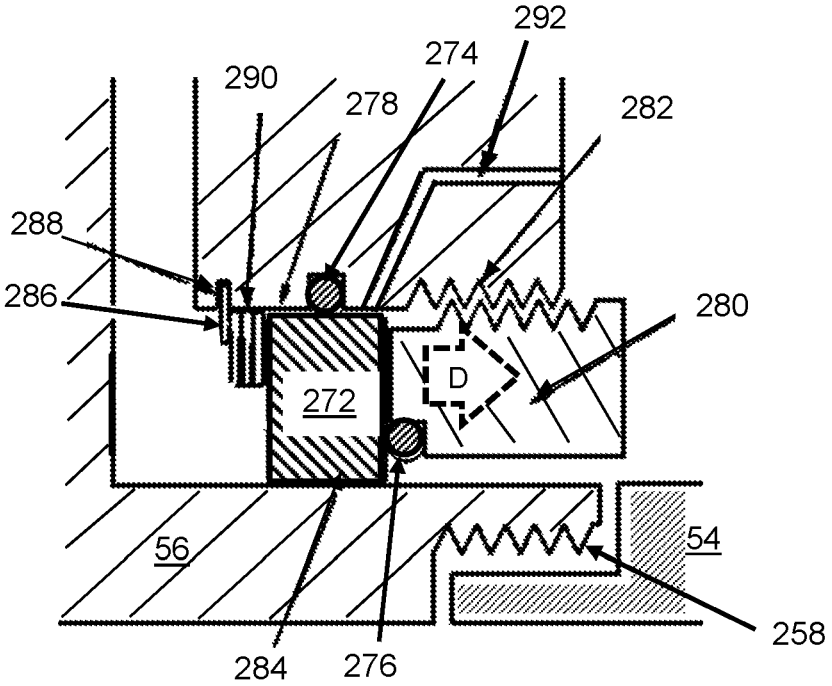
FIG. 8 is a cross-sectional view of the call-out A in FIG. 6.
Figure 9:
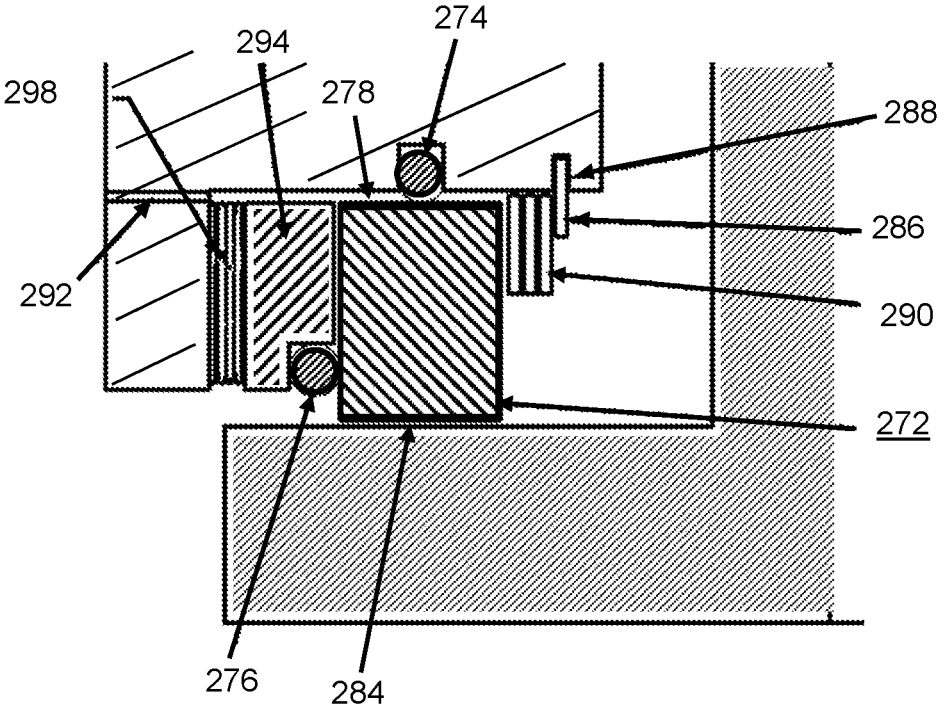
FIG. 9 is a cross-sectional view of the call-out B in FIG. 6

The restrictor mechanisms of the invention as illustrated in FIG. 6 are shown in greater detail in FIG. 8 and FIG. 9.

Referring first to FIG. 8 the suction side restrictor 252 is shown in vertical axial cross section. The restrictor body 272 is supported by means of a pair of O-rings 274, 276. The body may be made of a polymer, for example polyurethane. The present inventor has found that exposing only a portion of the restrictor outside surface 278 to the full pressure of the gland water can achieve the same result as the use of the restrictor arrangement in FIGS. 1-3. Here, if screw threaded ring 280, which mates with complementally threaded formation 282, is screwed outward to move axially away from the impeller unit (that is, to the right hand side of the drawing in the direction of arrow D), less of surface 278 will be exposed to the left of O-ring 274 until, when the entire surface is isolated from the gland water, restrictor body 272 will be de-energized and deactivated.

Flow-rate is then determined by the amount the restrictor can be expanded by water pressure, and how compressible the restrictor material is. Turning ring 280 in the opposite direction will gradually expose surface 278 to water pressure again, progressively re-energizing the restrictor and returning it to sealing operation.

Adjusting the balance between hydrodynamic pressure generated by the rotating annular extension 56, which acts on the restrictor internal diametric surface 284, and the amount of the outside diametric surface area 278 exposed to flushing water pressure, can be used to vary the flow of water passing between restrictor 272 and annular extension 56. Once the position of balance is determined, a circlip 286 is inserted into a circlip-receiving groove 288 and an appropriate number of shims 290 are fitted to provide containment for restrictor 272. Venting to atmosphere is enabled by the provision of venting port 292.

In FIG. 9, a secondary throat restrictor mechanism 254 of mirrored design to restrictor mechanism 252 is shown in vertical axial cross section. This restrictor is located shaft-side of impeller unit 200. It shares a number of like parts found in mechanism 252 and these carry like numbering. However, instead of having an adjustable ring (280 in FIG. 8), the mechanism has a retainer 294 and a further set of shims 296 as axial displacement is not necessary. The embodiments of FIGS. 8 and 9 disclose an alternative throat seal assembly that is free of water galleries and cover plates.

Figure 10:
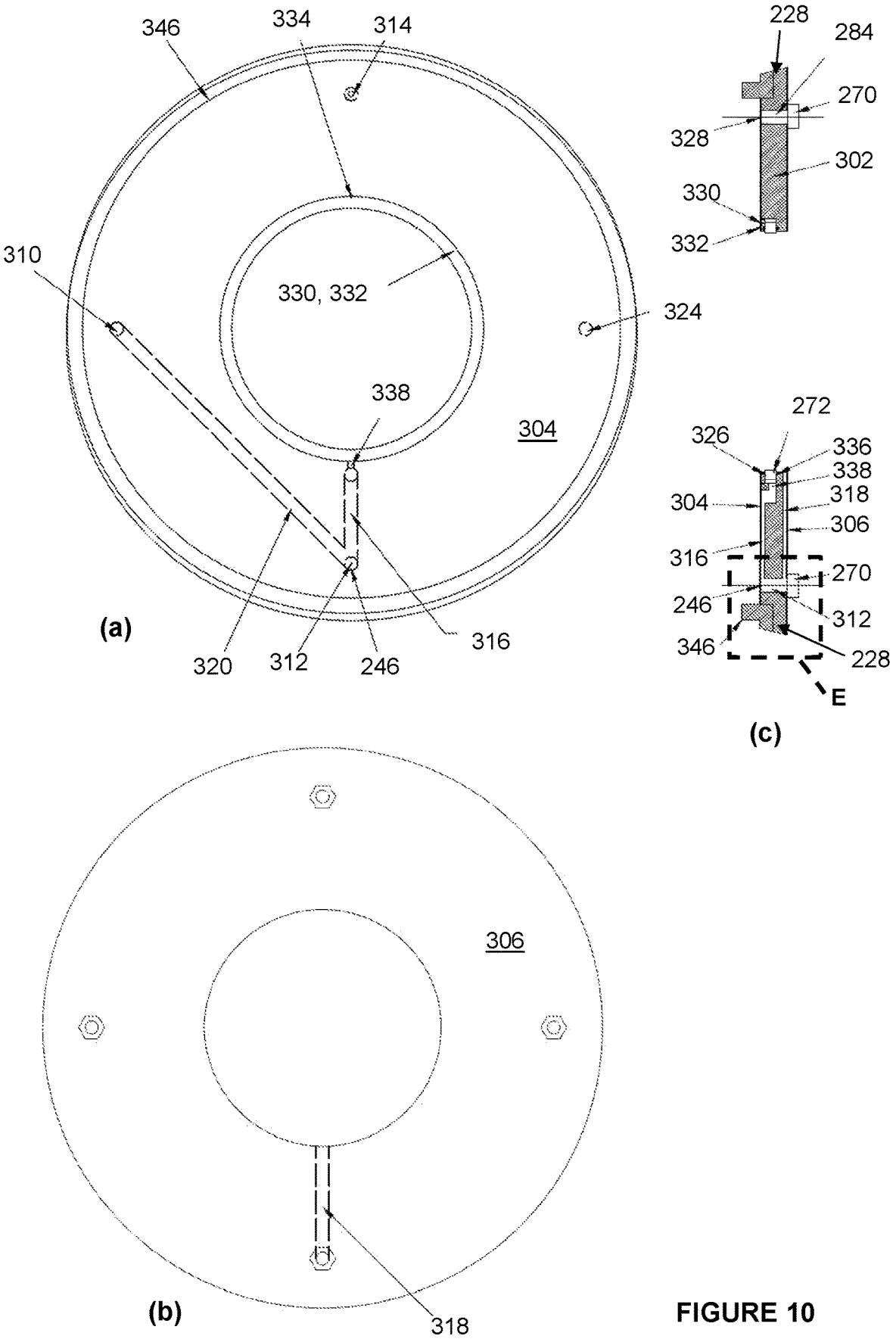
FIG. 10 is a cross-sectional view of the call-out D in FIG. 6 and includes side views of the suction side plate assembly of the pump in the preferred embodiment.

FIG. 10 presents (a) front, (b) rear and (c) side cross-sectional views of the throat restrictor assembly of FIG. 6, callout box D. Like parts carry like numbers and unless necessary to explain, will not be explained further. A centre plate 302 is flanked by inner 304 and outer 306 side plates.

Periphery seal 346, which has an equivalent function to seal 46 in FIG. 1, has a generally L-shaped profile.

Water galleries 316, 318 and 320 are milled into the centre plate, which, in this embodiment, is made from carbon steel and nickel plated. Cover plates 304 and 306 are of grade 316 stainless steel, and are glued to the centre plate with metal binding adhesive. It will be apparent to those of skill in the art that other materials may be employed, depending on pump service. Gallery 320 extends from orifice 246 (encountered previously in FIG. 7) to a mounting hole 310, providing communication with a second mounting hole 312, which receives a bolt 256 (shown in FIG. 7). Further mounting holes are provided, numbered 314 and 324. A pressure transducer for measuring restrictor energising pressure (not shown) is installed in mounting hole 310.

Water orifice 328 through the centre plate allows for gauge tapping.

A square section restrictor 272 is provided to seal against the impeller throat extension (not shown). O-rings 326, 336 provide lateral sealing on the axially directed sides of the restrictor. A threaded seal retaining plate 330 and washer 332 are located at the inner diametrical surface of the centre plate, together with a Scotch key 334 for secure fastening. Generally diametrically opposite the Scotch key position, there is a cross-drilling cut-out 338 at the radially outer surface of the restrictor 272 adjacent.

Figure 11:
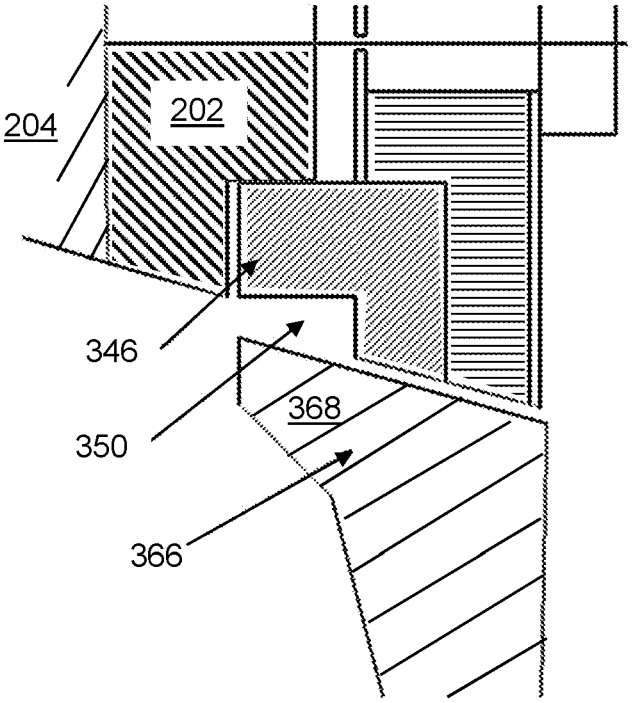
FIG. 11 an alternative configuration for the callout portion marked E in FIG. 10.

FIG. 11 depicts an alternative configuration for the callout portion E from FIG. 10. Here it is seen that volute liner 366 may have an inwardly extending formation 368 that overlaps the periphery seal 346. This leads to creation of a fluid dead-zone in the crook of the L 350 (seen in FIG. 11), in which flow is minimal and particles are found to gather. This creates additional sealing on account of an effect referred to as sanding, whereby accretion of sand or other particles from the slurry eventually fill this so-called static area, providing a barrier against abrasion. This example shows a two piece polyurethane or elastomer volute liner, as a one piece metal volute liner is easily modified.

Figure 12:
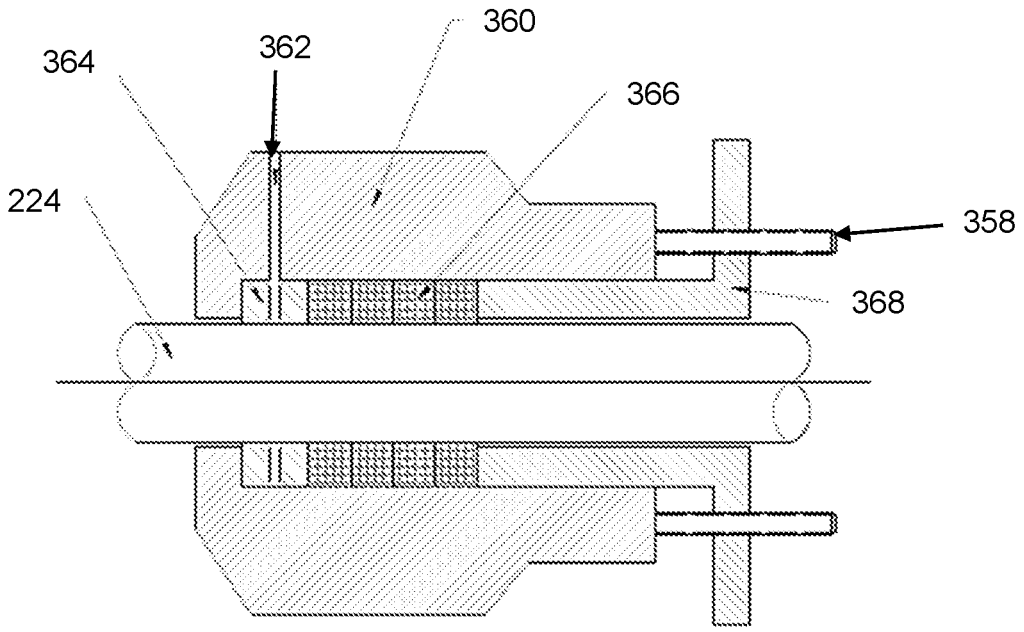
FIG. 12 provides an axial cross sectional view of a stuffing box according to a preferred embodiment.
Figure 12:
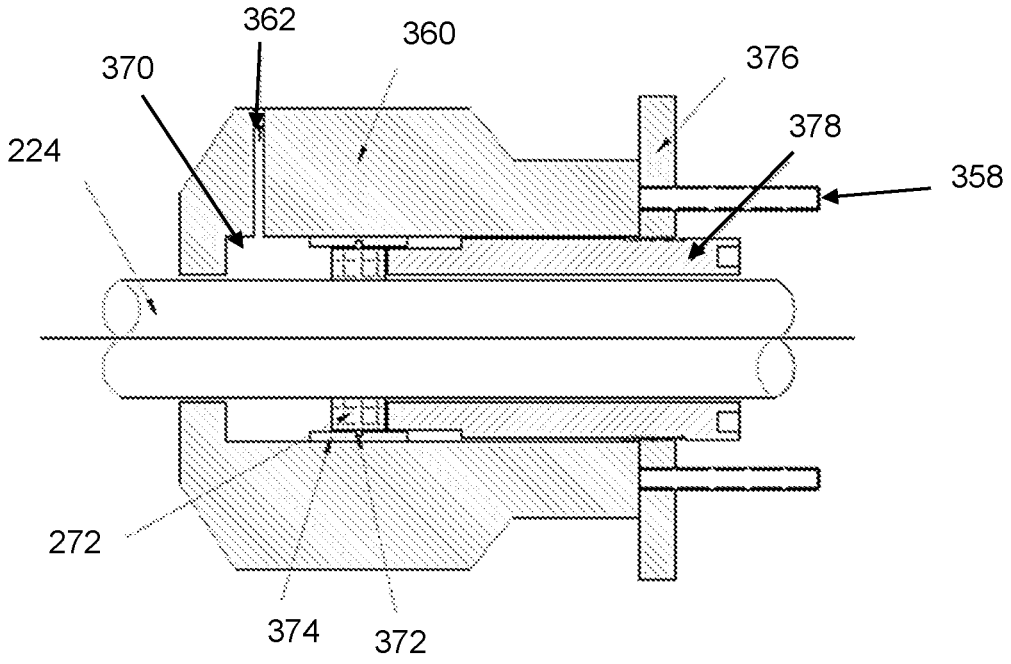

FIG. 12 is an axial cross section of a modified stuffing box for fitting on the shaft in sealing engagement with the impeller and gland distribution assembly of FIGS. 7 to 11. In it a standard form replaceable stuffing box housing 360 having a water gallery 362 is placed operatively around shaft 224. The housing is fastened to the pump body (not shown) by bolts 358.

Instead of gallery 362 leading to a lantern restrictor ring 364 of the kind shown in FIG. 1, which abuts gland packing 366, which in turn bears against an single-piece adjustment collar 368, a vacant chamber 370 is left for filling with gland water. The chamber is axially bounded at the impeller end by a square section restrictor 272 of the kind shown in FIG. 9. Sealing between the outer diametrical surface of restrictor 272 and the inner diametrical surface of housing 360 is provided by means of an O-ring 372 mounted in a supporting mounting ring 374. The adjustment collar is provided in the form of a separate ring 376 which fits around an elongate adjustment sleeve 378. The sleeve is brought to bear axially directly against the pump side end of restrictor 272. Gland water enters port 362, travels down into the lantern restrictor in (a), or into the empty cavity in (b), then turns left (in the drawing) to enter the pump and eye of the secondary impeller (not shown). The restrictor controls leakage between it and drive shaft 224, which would normally in the prior art be fitted with a wear sleeve, to the outside world. The restrictor in this application therefore servers as a pseudo gland packing.

The comparison in FIG. 12 demonstrate that a conventional stuffing box can be fitted with an adjustable restrictor that can serve as a single, pseudo-gland packing. In the absence of a lantern restrictor, which in conventional pumps loosely controls gland water flow-rate into the pump, gland water flow-rate would instead controlled by a pressure-compensated flow control such as a Maric valve. Unlike gland packing, which requires routine gland adjustment to maintain an acceptable leakage rate, testing suggests that the restrictor is suitable to be a "set and forget" feature. This example fits into an unmodified stuffing box housing and mounting 374 would be secured in place using a suitable adhesive.

Benefits achieved by the assembly of the invention in its various embodiments include, without limitation, the following:

a. Reduced flushing and gland water consumption,
b. Reduced water addition to slurry, avoiding excessive slurry dilution;
c. Increased pump efficiency by elimination of recirculation of working fluid;
d. Elimination of a throat bush and associated wear points;
e. Individual flow rate adjustment of lantern restrictors;
f. The lantern restrictors self-align to the impeller sleeves (at both the drive shaft and inlet ends of the impeller); and
g. Provision of the additional sleeve as an extension at the impeller inlet side allows sealing of the impeller against lantern restrictors at the inlet of the pump, providing a seal against slurry ingress to the space between housing wall and impeller, as well as an additional means of support for the shaft/impeller assembly, in the form of a semi-rigid liquid-lubricated bearing.
h. The invention allows a parts supplier to utilise obsolete spares in a retrofit market, and to avoid their becoming dead stock in their customer warehouses by enabling use to be made of a secondary impeller fastened to the primary fluid mover.

The benefits of the present invention above are expected to ease the maintenance burden borne by plant operators using slurry pumps significantly.

These embodiments illustrate selected examples of the method and apparatus of the invention providing means for protecting vulnerable surfaces in a slurry pump from wear caused by abrasive particles in a working fluid. With the insight gained from this disclosure, the person skilled in the art is well placed to discern further embodiments by means of which to put the claimed invention into practice.

The invention claimed is:

1. A centrifugal pump assembly comprising:
a housing having a suction-side inlet and a fluid delivery outlet,
a shrouded impeller rotatably mounted in the housing, and
support means operatively arranged for supporting the impeller from the suction side thereof in sealing relationship with the housing, wherein:
the support means includes an annular extension portion extending coaxially outwardly from the impeller into the suction-side inlet of the housing,
said sealing relationship is established by a restrictor assembly installed in the suction-side inlet to operatively bear against an outer surface of the extension portion,
the impeller comprises:
a suction side shroud,
a shaft side shroud opposing the suction side shroud, and
a space between either or both of the shrouds and the housing, the space being fillable with abrasive-excluding fluid,
the space on the suction side is bounded by the restrictor assembly, the restrictor assembly comprises an adjustably positionable restrictor body for sealing against an opposing surface of the extension portion, and the centrifugal pump assembly further comprises fluid-activated mechanical means operable to adjust a position of the restrictor body.

2. The pump assembly of claim 1, wherein the mechanical means causes displacement of the restrictor body in an axial direction substantially parallel to the impeller shaft.

3. The pump assembly according to claim 1, wherein the restrictor body is fluid-activated.

4. The pump assembly of claim 1, wherein the extension portion annular and the restrictor assembly further comprises means operable for adjusting fluid pressure being exerted on the restrictor body, the restrictor body having a surface arranged for operatively sealing against said opposing surface of the extension portion.

5. The pump assembly according to claim 1, wherein the restrictor assembly comprises a groove in a surface of the suction-side inlet, the restrictor body comprises a lantern restrictor ring operatively seated in the groove, and the restrictor assembly further comprises means operable for applying fluid under pressure against the lantern restrictor ring while in the groove, thereby urging the lantern restrictor ring against the extension portion outer surface in sealing relationship.

6. The pump assembly according to claim 1, further comprising shaft sealing means wherein a restrictor assembly having a lantern ring is applied between the housing and a shaft-receiving portion extending shaft-side of the impeller.

7. A centrifugal pump assembly comprising:

a housing having a suction side inlet and a fluid delivery outlet;

a shrouded impeller rotatably mounted in the housing;

support means operatively arranged for supporting the impeller from its suction side in sealing relationship with the housing; and a fluid distribution system configured for promoting substantially equal distribution of gland water from a source on a first side of the impeller to a gallery on an opposite second side of the impeller.

8. The pump assembly of claim 7, wherein the distribution system comprises a passage leading from a cavity on the first side of the impeller, in which cavity an arrangement of secondary vanes of the impeller is rotatable, through a primary vane arrangement of the impeller to the gallery on the second side of the impeller.

9. The pump assembly of claim 7, wherein the support means comprises an annular extension portion extending coaxially outwardly from the impeller into the suction-side inlet of the housing.

10. The pump assembly of claim 9, wherein said sealing relationship is established by a restrictor assembly installed in the suction-side inlet to operatively bear against an outer surface of the annular extension portion.

11. The pump assembly of claim 10, wherein the gallery is bounded by the restrictor assembly and a seal operatively located to act at a periphery of the shroud.

12. The pump assembly of claim 7, not comprising a throat bush.

13. The pump assembly of claim 7, wherein the gallery is located between a shroud of the impeller and an adjacent wall of the housing, the gallery being Tillable in use with abrasive-excluding fluid for excluding slurry therefrom.

* * * * *